US007182665B2

(12) United States Patent
Thai

(10) Patent No.: US 7,182,665 B2
(45) **Date of Patent: *Feb. 27, 2007**

(54) BUBBLE GENERATING ASSEMBLY

(75) Inventor: Douglas Thai, Walnut, CA (US)

(73) Assignee: Arko Development Ltd., Hong Kong (HK)

( * ) Notice: Subject to any disclaimer, the term of this patent is extended or adjusted under 35 U.S.C. 154(b) by 284 days.

This patent is subject to a terminal disclaimer.

(21) Appl. No.: 10/655,842

(22) Filed: Sep. 5, 2003

(65) Prior Publication Data

US 2004/0082253 A1 Apr. 29, 2004

Related U.S. Application Data

(63) Continuation of application No. 10/247,994, filed on Sep. 20, 2002, now Pat. No. 6,616,498, which is a continuation-in-part of application No. 10/195,816, filed on Jul. 15, 2002, now Pat. No. 6,620,016, which is a continuation-in-part of application No. 10/133,195, filed on Apr. 26, 2002, now Pat. No. 6,659,831, which is a continuation-in-part of application No. 10/099,431, filed on Mar. 15, 2002, now Pat. No. 6,659,834.

(51) Int. Cl.
*A63H 33/28* (2006.01)

(52) U.S. Cl. ..... 446/15; 446/21

(58) Field of Classification Search ..... 446/15–21
See application file for complete search history.

(56) References Cited

U.S. PATENT DOCUMENTS 185,279 A * 12/1876 Baker et al. ..... 446/18
430,095 A 6/1890 Thain
616,239 A 12/1898 King
660,485 A * 10/1900 Bradshaw ..... 40/408
2,041,423 A 5/1936 Mausolf
2,213,391 A 9/1940 Gamble
2,225,702 A 12/1940 Lyon, Jr.
2,393,039 A * 1/1946 Gilchrist, Jr. ..... 446/17
2,396,433 A 3/1946 Pimblett
2,398,513 A * 4/1946 Bradley ..... 446/15
2,527,935 A 10/1950 Joel, II
2,547,825 A 4/1951 King
2,560,582 A * 7/1951 Limber ..... 446/18
2,587,535 A * 2/1952 Scott ..... 446/18
2,587,537 A 2/1952 Scott
2,606,396 A 8/1952 Hill
2,632,281 A 3/1953 Schmidt, Jr.
2,659,177 A 11/1953 Kopf (Continued)

OTHER PUBLICATIONS

Website: www.m-w.com, dictionary.*

*Primary Examiner*—Bena Miller
(74) *Attorney, Agent, or Firm*—Raymond Sun

(57) ABSTRACT

A bubble generating assembly has a housing with a wiping bar secured to a permanent location extending across a portion of the front opening of the housing. The bubble generating assembly further includes a container coupled to the housing and retaining bubble solution, a trigger mechanism, a bubble generating ring positioned adjacent the front opening, a tubing that couples the interior of the container with the ring, and a link assembly that couples the trigger mechanism and the ring in a manner in which actuation of the trigger mechanism causes the ring to be moved from a first position to a second position across the wiping bar.

19 Claims, 12 Drawing Sheets

U.S. PATENT DOCUMENTS

| | | | | |
|---|---|---|---|---|
| 2,700,845 | A | | 2/1955 | Arliss |
| 2,711,051 | A | | 6/1955 | Pick |
| 2,736,988 | A | | 3/1956 | Fisher |
| 2,974,438 | A | | 3/1961 | Hopkins |
| 2,987,847 | A | | 6/1961 | Jones |
| 3,071,888 | A | | 1/1963 | Knott |
| 3,100,947 | A | | 8/1963 | Hellman |
| 3,109,255 | A | | 11/1963 | Hein |
| 3,183,621 | A | | 5/1965 | Allen, Jr. |
| 3,228,136 | A | | 1/1966 | Rouse |
| 3,323,250 | A | | 6/1967 | Gibbons |
| 3,420,412 | A | | 1/1969 | Greene |
| 3,579,898 | A | | 5/1971 | Hein |
| 3,601,313 | A | | 8/1971 | Berg |
| 3,604,144 | A | | 9/1971 | Span |
| 3,731,412 | A | | 5/1973 | Winslow |
| 3,736,694 | A | | 6/1973 | Lebensfeld |
| 3,845,583 | A | | 11/1974 | Ziff |
| 3,913,260 | A | | 10/1975 | Corbett |
| 3,925,923 | A | | 12/1975 | La Fata et al. |
| 3,952,447 | A | | 4/1976 | Hackell |
| 4,246,717 | A | | 1/1981 | Wachtel |
| D263,062 | S | | 2/1982 | Rasmussen |
| 4,423,565 | A | | 1/1984 | Bart |
| 4,438,955 | A | | 3/1984 | Ryan |
| 4,467,552 | A | | 8/1984 | Jernigan |
| 4,481,731 | A | | 11/1984 | La Fata et al. |
| 4,603,021 | A | | 7/1986 | Urso |
| 4,700,965 | A | | 10/1987 | Kinberg |
| 4,775,348 | A | | 10/1988 | Collins |
| 4,804,346 | A | | 2/1989 | Sheng |
| RE32,973 | E | | 7/1989 | Panzarella |
| D304,466 | S | | 11/1989 | Brown |
| 4,957,464 | A | | 9/1990 | Perez |
| 4,988,319 | A | | 1/1991 | Shen |
| 5,035,665 | A | | 7/1991 | Sheng |
| 5,230,648 | A | | 7/1993 | Kelly et al. |
| 5,234,129 | A | | 8/1993 | Lau |
| 5,395,274 | A | | 3/1995 | Myers |
| 5,462,469 | A | | 10/1995 | Lei |
| 5,498,191 | A | * | 3/1996 | DeMars ..... 446/15 |
| 5,520,564 | A | | 5/1996 | DeMars |
| 5,542,869 | A | | 8/1996 | Petty |
| 5,613,890 | A | * | 3/1997 | DeMars ..... 446/15 |
| 5,695,379 | A | | 12/1997 | Ho |
| 6,547,622 | B2 | | 11/1998 | Schramm |
| 5,842,899 | A | | 12/1998 | Cernansky et al. |
| 5,850,945 | A | | 12/1998 | Frankel |
| 5,879,218 | A | | 3/1999 | Tao |
| 6,062,935 | A | | 5/2000 | Gross |
| 6,102,764 | A | | 8/2000 | Thai |
| 6,139,391 | A | | 10/2000 | Thai |
| 6,149,486 | A | | 11/2000 | Thai |
| 6,200,184 | B1 | | 3/2001 | Rich et al. |
| 6,315,627 | B1 | | 11/2001 | Thai |
| 6,331,130 | B1 | | 12/2001 | Thai |
| 6,416,377 | B1 | | 7/2002 | Bart |
| 6,544,091 | B1 | | 4/2003 | Thai |
| 6,620,016 | B1 | | 9/2003 | Thai |
| 6,659,830 | B2 | | 12/2003 | Thai |

* cited by examiner

BUBBLE GENERATING ASSEMBLY

RELATED CASES

This is continuation of Ser. No. 10/247,994 filed Sep. 20, 2002, entitled "Bubble Generating Assembly", now U.S. Pat. No. 6,616,498, which is in turn a continuation-in-part of Ser. No. 10/195,816, entitled "Bubble Generating Assembly", filed Jul. 15, 2002, now U.S. Pat. No. 6,620,016, which is in turn a continuation-in-part of Ser. No. 10/133,195, entitled "Apparatus and Method for Delivering Bubble Solution to a Dipping Container", filed Apr. 26, 2002 now U.S. Pat. No. 6,659,831, which is in turn a continuation-in-part of Ser. No. 10/099,431, entitled "Apparatus and Method for Delivering Bubble Solution to a Dipping Container", filed Mar. 15, 2002 now U.S. Pat. No. 6,659,834, whose disclosures are incorporated by this reference as though fully set forth herein.

BACKGROUND OF THE INVENTION

1. Field of the Invention

The present invention relates to bubble toys, and in particular, to a bubble generating assembly which automatically forms a bubble film over a bubble ring without the need to dip the bubble ring into a container or a dish of bubble solution.

2. Description of the Prior Art

Bubble producing toys are very popular among children who enjoy producing bubbles of different shapes and sizes. Many bubble producing toys have previously been provided. Perhaps the simplest example has a stick with a circular opening or ring at one end, resembling a wand. A bubble solution film is produced when the ring is dipped into a dish that holds bubble solution or bubble producing fluid (such as soap) and then removed therefrom. Bubbles are then formed by blowing carefully against the film. Such a toy requires dipping every time a bubble is to created, and the bubble solution must accompany the wand from one location to another.

Recently, the market has provided a number of different bubble generating assemblies that are capable of producing a plurality of bubbles. Examples of such assemblies are illustrated in U.S. Pat. Nos. 6,149,486 (Thai), 6,331,130 (Thai) and 6,200,184 (Rich et al.). The bubble rings in the bubble generating assemblies in U.S. Pat. Nos. 6,149,486 (Thai), 6,331,130 (Thai) and 6,200,184 (Rich et al.) need to be dipped into a dish that holds bubble solution to produce films of bubble solution across the rings. The motors in these assemblies are then actuated to generate air against the films to produce bubbles.

All of these aforementioned bubble generating assemblies require that one or more bubble rings be dipped into a dish of bubble solution. In particular, the child must initially pour bubble solution into the dish, then replenish the solution in the dish as the solution is being used up. After play has been completed, the child must then pour the remaining solution from the dish back into the original bubble solution container. Unfortunately, this continuous pouring and re-pouring of bubble solution from the bottle to the dish, and from the dish back to the bottle, often results in unintended spillage, which can be messy, dirty, and a waste of bubble solution.

Thus, there remains a need to provide an apparatus and method for forming a film of bubble solution across a bubble ring without the need to dip the bubble ring into a dish of bubble solution.

SUMMARY OF THE DISCLOSURE

It is an object of the present invention to provide an apparatus and method for effectively forming a film of bubble solution across a bubble ring.

It is another object of the present invention to provide an apparatus and method for effectively forming a film of bubble solution across a bubble ring in a manner which minimizes spillage of the bubble solution.

It is yet another object of the present invention to provide an apparatus having a simple construction that effectively forms a film of bubble solution across a bubble ring.

It is a further object of the present invention to provide an apparatus where droplets of unused bubble solution can be returned to the bubble solution container, and having a valve that prevents bubble solution from spilling from the bubble solution container.

The objectives of the present invention are accomplished by providing a bubble generating assembly that has a housing with a wiping bar secured to a permanent location extending across a portion of the front opening of the housing. The bubble generating assembly further includes a container coupled to the housing and retaining bubble solution, a trigger mechanism, a bubble generating ring positioned adjacent the front opening, a tubing that couples the interior of the container with the ring, and a link assembly that couples the trigger mechanism and the ring in a manner in which actuation of the trigger mechanism causes the ring to be moved from a first position to a second position across the wiping bar.

DETAILED DESCRIPTION OF THE PREFERRED EMBODIMENTS

Figure 1:
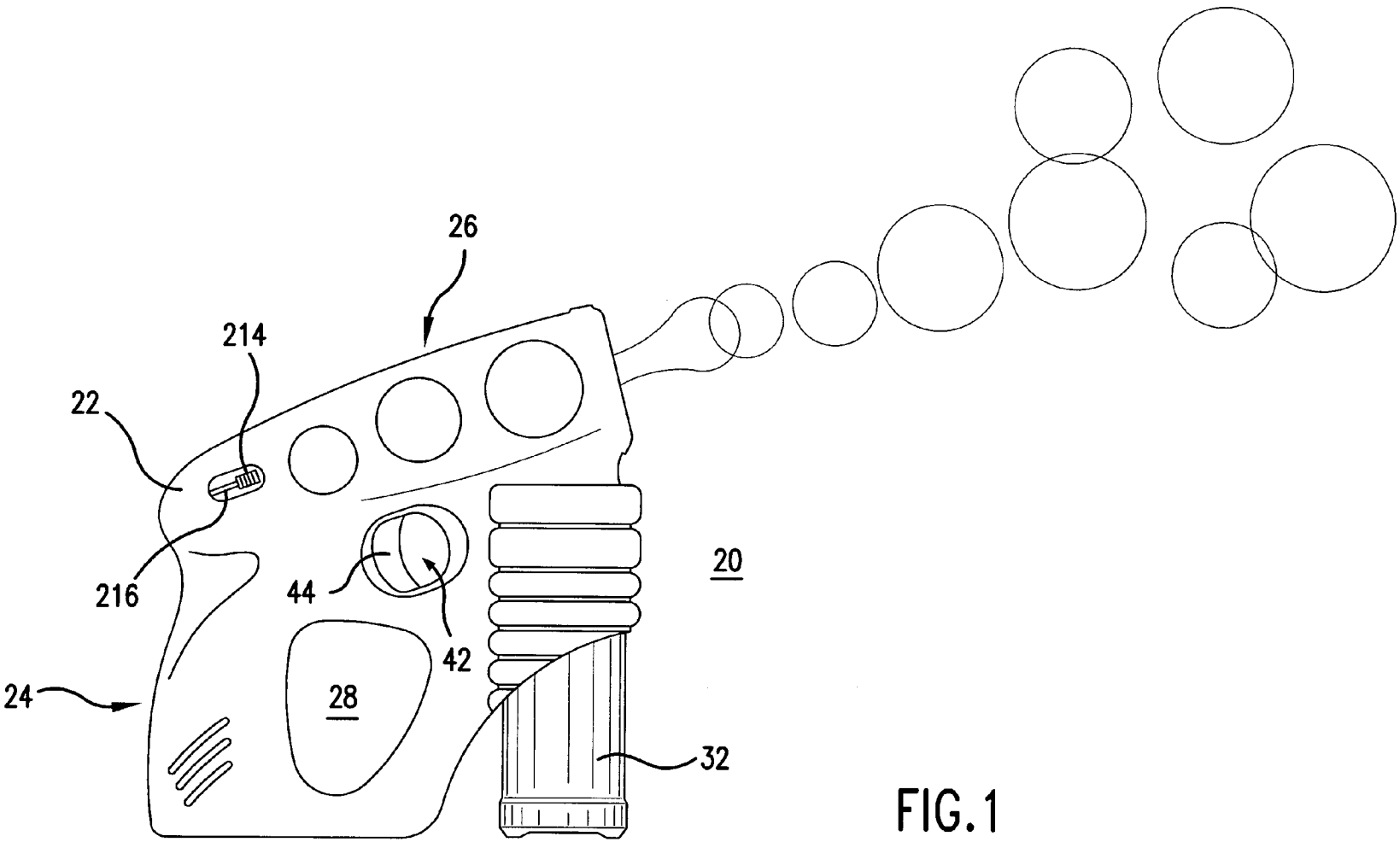
FIG. 1 is a side view of a bubble generating assembly according to one embodiment of the present invention.
Figure 2:
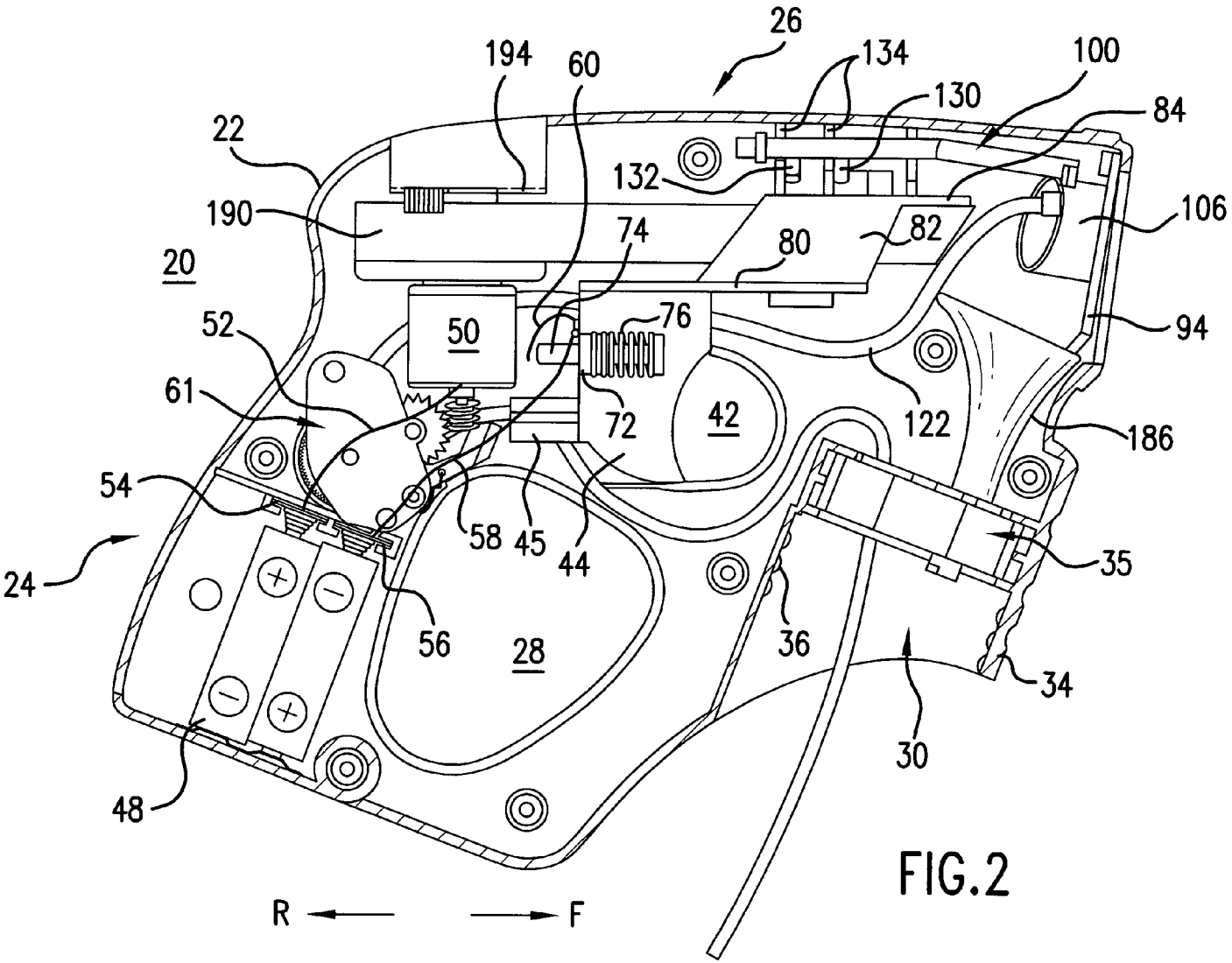
FIG. 2 is a cross-sectional view of the assembly of FIG. 1 shown with the trigger in the normal position.
Figure 3:
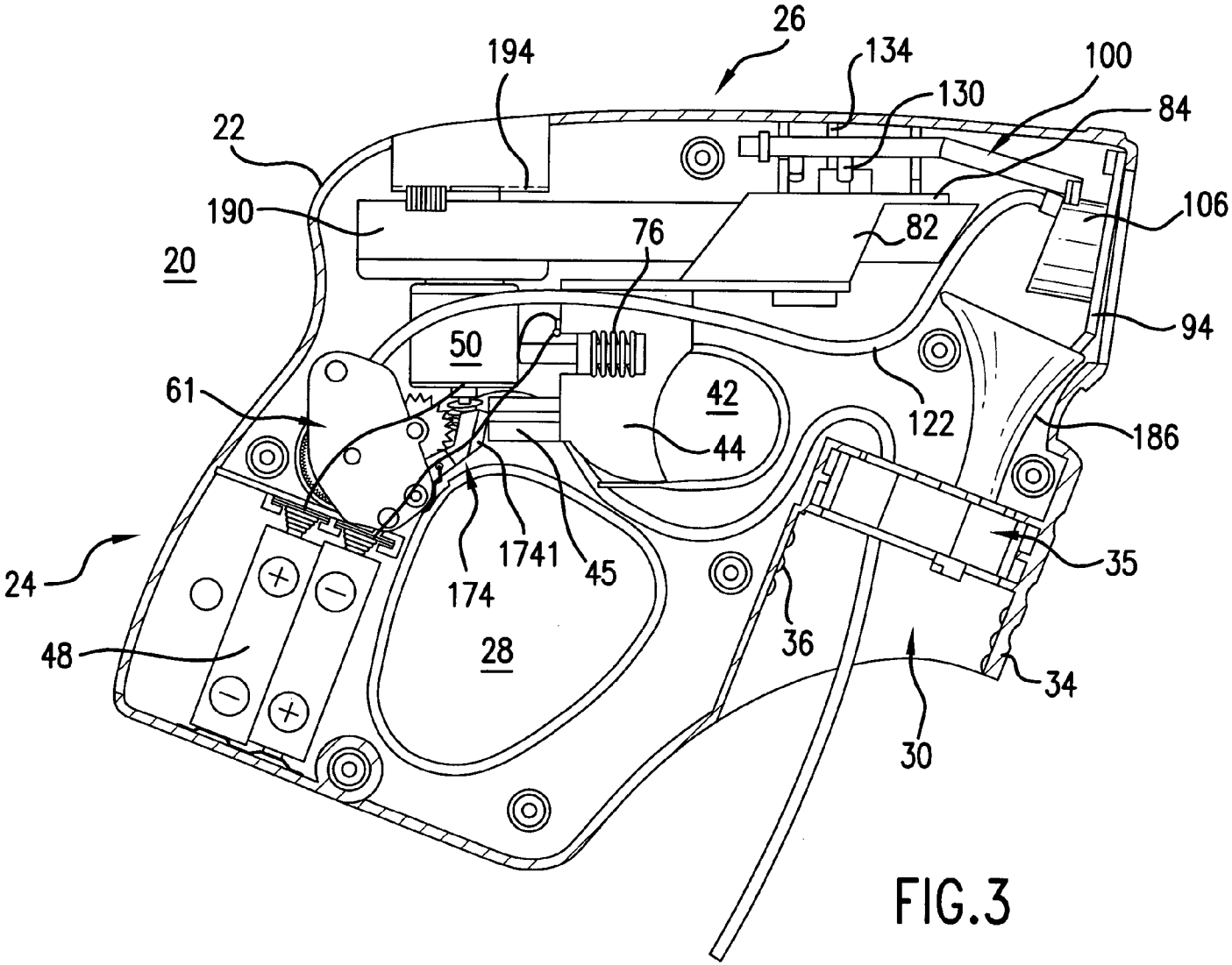
FIG. 3 is a cross-sectional view of the assembly of FIG. 1 shown with the trigger being actuated.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

FIGS. 1–14 illustrate one embodiment of a bubble generating assembly 20 according to the present invention. The assembly 20 has a housing 22 that includes a handle section 24 and an barrel section 26. The housing 22 can be provided in the form of two symmetrical outer shells that are connected together by, for example, screws or welding or glue. These outer shells together define a hollow interior for housing the internal components of the assembly 20, as described below. The handle section 24 has a first opening 28 through which a user can extend his or her fingers to grip the handle section 24, and a second opening 42 in which a trigger 44 is positioned. The front portion of the opening 28 defines a receiving space 30 that removably couples a conventional bubble solution bottle 32. The bubble solution bottle 32 can be provided in the form of any of the conventional bubble solution containers that are currently available in the marketplace. A connecting section 34, which resembles an annular wall, is provided at the receiving space 30, and has internal threads 36 that are adapted to releasably engage the external threads (not shown) on the neck of the solution bottle 32. A connector 35 separates the interior of the housing 22 from the connecting section 34. In addition, a front opening 38 (see FIGS. 4 and 5) is provided at the front of the barrel section 26.

The handle section 24 houses a power source 48 which can include at least one conventional battery. A motor 50 is secured to the housing 22 at a location that is adjacent the trigger 44. The motor 50 is electrically coupled to the power source 48 via a first wire 52 and a first electrical contact 54. A second wire 58 couples a second electrical contact 56 of the power source 48 to a third electrical contact 60, which is adapted to releasably contact the motor 50 to form a closed electrical circuit. The third electrical contact 60 is attached to the trigger 44. A pump system 61 (described in greater detail below) is secured to the housing 22 at a position between the motor 50 and the power source 48, and is operatively coupled to the motor 50.

Referring to FIGS. 2, 3, 8 and 9, the trigger 44 comprises two vertical walls 64 and 66, with aligned horizontal slots 68 and 70 cut in the walls 64 and 66, respectively. A first horizontal shaft 72 extends through the aligned slots 68 and 70, with the opposing ends of the first horizontal shaft 72 fixedly secured to the housing 22 so that the first horizontal shaft 72 can slide back and forth along the horizontal slots 68 and 70 when the trigger 44 moves back and forth. The first horizontal shaft 72 has a central hole through which a second horizontal shaft 74 (which is oriented transverse to the first horizontal shaft 72) extends. A resilient member 76 (such as a spring) is carried on the forward end of the second horizontal shaft 74 and is positioned between the two walls 64, 66 and the front wall 67 of the trigger 44. Since the position of the first horizontal shaft 72 is fixed, the resilient member 76 normally biases the trigger 44 in the forward direction (see arrow F in FIG. 2) into the opening 42. When a user presses the trigger 44, the pressing force overcomes the natural bias of the resilient member 76 and pushes the trigger 44 in the rearward direction (see arrow R in FIG. 2) until the electrical contact 60 engages the motor 50, closing the electrical circuit and actuating the motor 50. When the user releases his or her grip on the trigger 44, the bias of the resilient member 76 will bias the trigger 44 in the forward direction to cause the electrical contact 60 to disengage the motor 50, thereby opening the electrical circuit so that the motor 50 is not powered by the power source 48 under normal (non-operation) circumstances.

Referring to FIGS. 2, 3 and 6–10, a horizontal platform 80 is carried on top of the walls 64, 66 of the trigger 44. A vertical piece 82 extends vertically from the top surface of the platform 80 at the front end of the platform 80, and a shelf 84 extends horizontally in a lateral manner from the top of the vertical piece 82. The shelf 84 is oriented to be parallel to the platform 80. A guide bar 86 is provided on the upper surface of the shelf 84. The guide bar 86 has a horizontal segment 88 and an angled segment 90. The guide bar 86 is operatively coupled to an actuation system that functions to cause a bubble ring 106 to experience reciprocating movement across a stationery wiping bar 94 that is fixedly secured to a collection funnel 186 at the location of the front opening 38. The wiping bar 94 can be a vertical bar that is positioned offset from the center of the front opening 38 (see FIGS. 4 and 5), and further reinforced by a transverse reinforcing segment 96 (secured to the housing 22) that connects the wiping bar 94 to the housing 22 so as to provide structural support to the rigidity of the wiping bar 94. Without the support provided by the reinforcing segment 96, the wiping bar 94 may break after extended contact with the bubble ring 106. In this regard, the platform 80, the vertical piece 82 and the shelf 84 also function as a link system between the trigger 44 and the actuation system so that movement of the trigger 44 is translated into movement by the actuation system.

Referring to FIGS. 2, 3, 6–11, the actuation system includes an angled pivot bar 100 and a resilient member 102. The pivot bar 100 has a horizontal rear segment 104 and an angled front segment 105 that angles downwardly with respect to the horizontal axis defined by the rear segment 104, the platform 80 and the shelf 84. A bubble generating ring 106 is attached to the front end of the front segment 105 at an upper portion of the ring 106. The pivot bar 100 further includes a guide leg 130 and a hook leg 132 that extend vertically downwardly from the rear segment 104. The resilient member 102 (which can be a spring) has one end that is secured to the housing 22 and an opposing end that is hooked to the hook leg 132. The guide leg 130 is positioned alongside the angled segment 90 of the guide bar 86, and is adapted to slide back and forth along the inner surface of the angled segment 90. The pivot bar 100 is retained in a fixed horizontal position (but with the capability of pivoting) with respect to the housing 22 by a plurality of spaced-apart hangers 134 that are secured to the top of the inside of the housing 22. Each hanger 134 has an opening through which the rear segment 104 extends, so that the rear segment 104 essentially can pivot about the horizontal axis defined by aligning these openings in the plurality of hangers 134.

Figure 15:
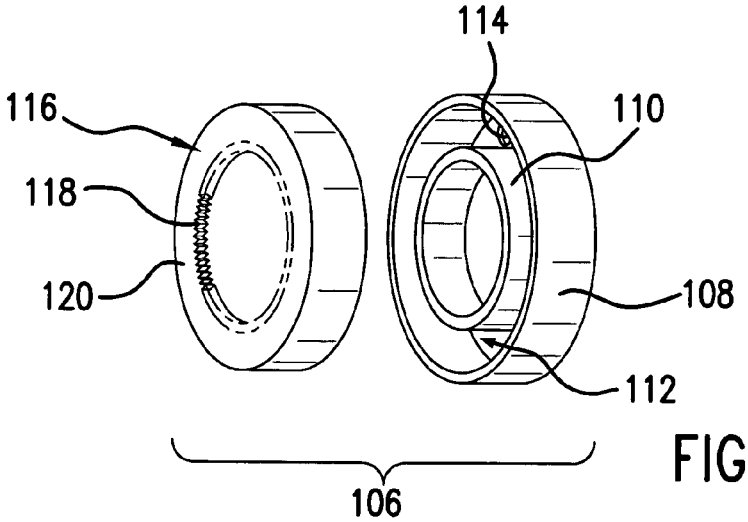
FIG. 15 is an exploded perspective view of the bubble ring of the assembly of FIG. 1.
Figure 16:
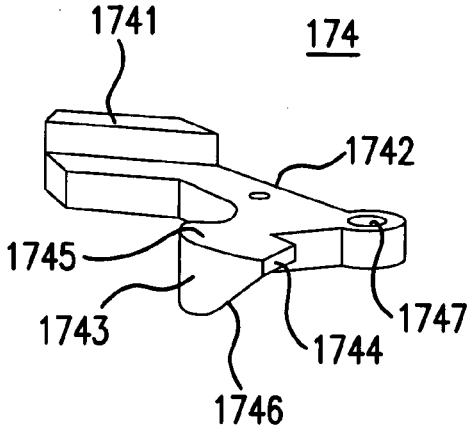
FIG. 16 is a perspective view of the slider of the pump system of FIG. 12.

The bubble ring 106 is adapted to be moved between a normal (non-operational) position (see FIGS. 2, 4, 6 and 8), in which the bubble ring 106 is positioned away from the central part of the front opening 38, to a bubble generating (actuated) position (see FIGS. 3, 5, 7 and 9), where the bubble ring 106 is positioned at about the central part of the front opening 38. The structure of the bubble ring 106 is illustrated in FIG. 15. The ring 106 has an annular base piece 108 that has a cylindrical wall 110 extending therein to define an annular chamber 112 therein. An opening 114 is provided in the base piece 108. The ring 106 also has an annular cover piece 116 that fits into the annular chamber 112 of the base piece 108. A plurality of outlets 118 can be provided along the inner annular surface, and/or the front surface 120, of the cover piece 116. A tubing 122 (see FIGS. 2 and 3) is attached to the opening 114 of the ring 106 to deliver bubble solution from the solution bottle 32 via the tubing 122 into the chamber 112 of the ring 106. The bubble solution from the chamber 112 can then leak out of the outlets 118 onto the front surface 120 of the ring 106.

Referring now to FIGS. 2, 3, 12 and 16–18, the assembly 20 includes a pump system that functions to pump the bubble solution from the solution bottle 32 to the bubble ring 106. The pump system includes the motor 50, the tubing 122, a guide wall 150, and a gear system that functions to draw bubble solution through the tubing 122. The gear system includes a motor gear 152 that is rotatably coupled to a shaft 154 of the motor 50, a gear housing plate 156, a first gear 158, a second gear 160, a resilient element 162 (such as a spring), two pressure rollers 164, 166, a shaft 168, and a slider 174. The motor gear 152 has teeth that are engaged with the teeth of the first gear 158. The first gear 158 is rotatably coupled to the gear housing plate 156, and has teeth that are engaged with the teeth of the second gear 160. The second gear 160 has an extension 161 positioned on the side of the second gear 160 adjacent to the gear housing plate 156. The second gear 160 rotates about an axis defined by the shaft 168, and the resilient element 162 is carried on the shaft 168 between the second gear 160 and an enlarged end of the shaft 168. The shaft 168 extends through the second gear 160 and an opening 169 in the gear housing plate 156 so that the second gear 160 rotates about the shaft 168 that is secured to the gear housing plate 156. The pressure rollers 164, 166 are spaced apart along the outer periphery of the second gear 160 and positioned to face away from the gear housing plate 156. Each pressure roller 164, 166 has a base section 170 and an upper section 172 which has a smaller diameter than the diameter of the base section 170. The base section 170 of each roller 164, 166 has a bore 180 that receives a holding pin 182 provided on a lateral surface of the second gear 160.

Figure 17:
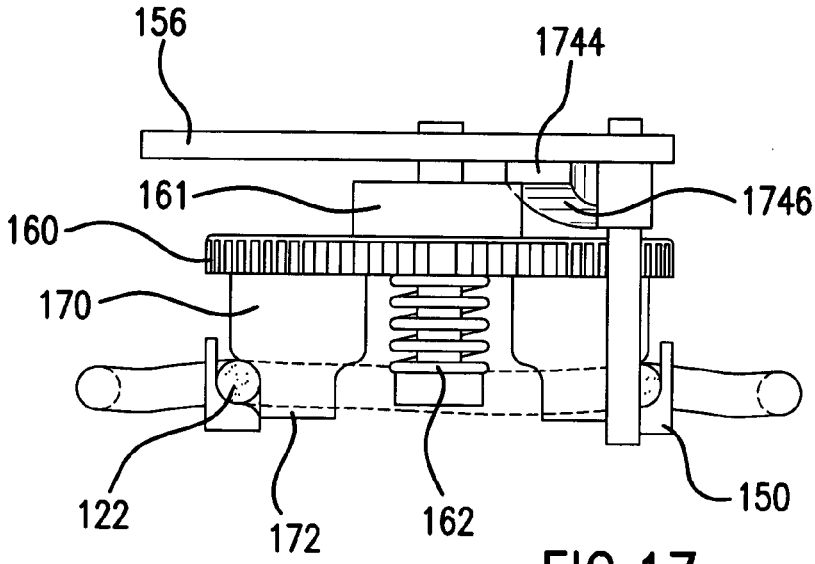
FIG. 17 is an isolated top plan view illustrating the relationship between the pressure rollers and the tubing when the assembly of FIG. 1 is in the normal non-operational condition.

The slider 174 is best illustrated in FIGS. 12 and 16–18. The slider 174 has a body section 1742 with an enlarged front portion 1741 that is adapted to be abutted by a pushing section 45 provided at the rear of the walls 64 and 66 of the trigger 44. A curved piece 1743 extends from the rear of the body section 1742. The thickness of the curved piece 1743 gradually decreases from the body section 1742 until it reaches its smallest thickness at its terminal tip 1744. In particular, this decreasing thickness (see FIGS. 16–18) is accomplished by providing a flat top surface 1745 and a bottom surface 1746 that gradually angles towards the top surface 1745 to reduce the thickness of the curved piece 1743. An opening 1747 is provided at the rear end of the body section 1742. A shaft 178 carries a resilient member 176 (e.g., a spring), and one end of the shaft 178 extends through the opening 1747 and into an opening 157 in the gear housing plate 156. The other end of the shaft 178 is fixedly secured to the housing 22. The resilient member 176 has a first hooked end 177 that is secured to a hole 179 in the slider 174, and a second hooked end 181 that is secured to a pole (not shown) in the housing 22. Thus, the slider 174 can be pivoted with respect to the gear housing plate 156 about an axis defined by the shaft 178, with the resilient member 176 functioning to normally bias the slider 174 to a first normal position that is shown in FIG. 17. In this normal position, the extension 161 of the second gear 160 is positioned adjacent the terminal tip 1744 of the slider 174, where the thickness of the curved piece 1743 is smallest. In addition, the tubing 122 extends from the interior of the solution bottle 32, through the connector 35, into the housing 22, and passes through a path (that is defined by the pressure rollers 164, 166, and the guide wall 150) that leads to the opening 114 of the bubble ring 106. At the location of the pressure rollers 164, 166 and the guide wall 150, the tubing 122 is positioned between the pressure rollers 164, 166 and the guide wall 150.

The pump system operates in the following manner. When the motor 50 is actuated, the motor gear 152 will rotate, thereby causing the first and second gears 158 and 160 to rotate as well. As the second gear 160 rotates, the pressure rollers 164, 166 will also rotate because they are carried by the second gear 160. As the pressure rollers 164, 166 rotate, they will apply selected pressure on different parts of the tubing 122 in the manner described below to draw bubble solution from the solution bottle 32 to the bubble ring 106.

A fan system is illustrated in FIGS. 2, 3, 6, 7, 13 and 14. An air generator 188 (such as a fan) is rotatably coupled to the top of the motor 50. A wind tunnel 190 is positioned in the barrel section 26, and has an opening 192 through which the air generator 188 is positioned. The opening 192 communicates with an opening 194 at the top of the housing 22 so that air from the outside can be directed through the opening 194 into the housing 22, and then through the opening 192 into the wind tunnel 190 so that the air generator 188 can direct the air as a stream of air through the length of the wind tunnel 190 to the front end 196 of the wind tunnel 190. The front end 196 of the wind tunnel 190 has an opening, and is positioned adjacent the bubble ring 106 so that the stream of air can be blown against the bubble ring 106 to generate bubbles.

The fan system is provided with an air control system that regulates the amount of air being introduced into the housing 22 from the outside. The air control system includes two parallel guide members 210 and 212 (shown in phantom in FIGS. 6, 7, 13 and 14) that are attached to the housing 22. A space is defined between the parallel guide members 210 and 212. Referring also to FIG. 1, a slide member 214 extends through a slot 216 in the housing 22 to the exterior so that the user can adjust the air control system by sliding the slide member 214 back and forth in the slot 216. The slide member 214 has a ridge 218 that is positioned between the parallel guide members 210 and 212. When the slide member 214 is positioned entirely above the wind tunnel 190 (i.e., to the front-most position as viewed in the orientation of FIG. 1) such that the slide member 214 does not cover any part of the opening 192 (see FIGS. 6 and 13), the maximum amount of external air is allowed to enter and flow through the openings 194 and 192. On the other hand, as the slide member 214 is slid rearwardly along the slot 216 (as viewed from the orientation of FIG. 1), the slide member 214 will cover varying portions of the opening 192 (see FIGS. 7 and 14), so that decreasing amounts of external air are allowed to enter and flow through the openings 194 and 192. When new batteries (i.e., the power supply 48) are used, the air generator 188 will be stronger so that less external air is needed to generate a consistent stream of air to be directed through the wind tunnel 190 at the bubble ring 106. On the other hand, when the batteries get older, the air generator 188 will become progressively weaker so that more external air is needed to generate a consistent stream of air to be directed through the wind tunnel 190 at the bubble ring 106. Thus, depending on the strength of the power supply 48 and the air generator 188, the user can adjust the amount of external air introduced through the openings 194 and 192 into the wind tunnel 190 by blocking varying portions of the opening 192.

In addition to the above, a collection funnel 186 is positioned inside the housing 22 and below the location of the bubble ring 106. The collection funnel 186 can collect and receive droplets of bubble solution that have dripped from the bubble ring 106, and deliver these droplets of bubble solution back into the interior of the solution bottle 32.

Figure 19:
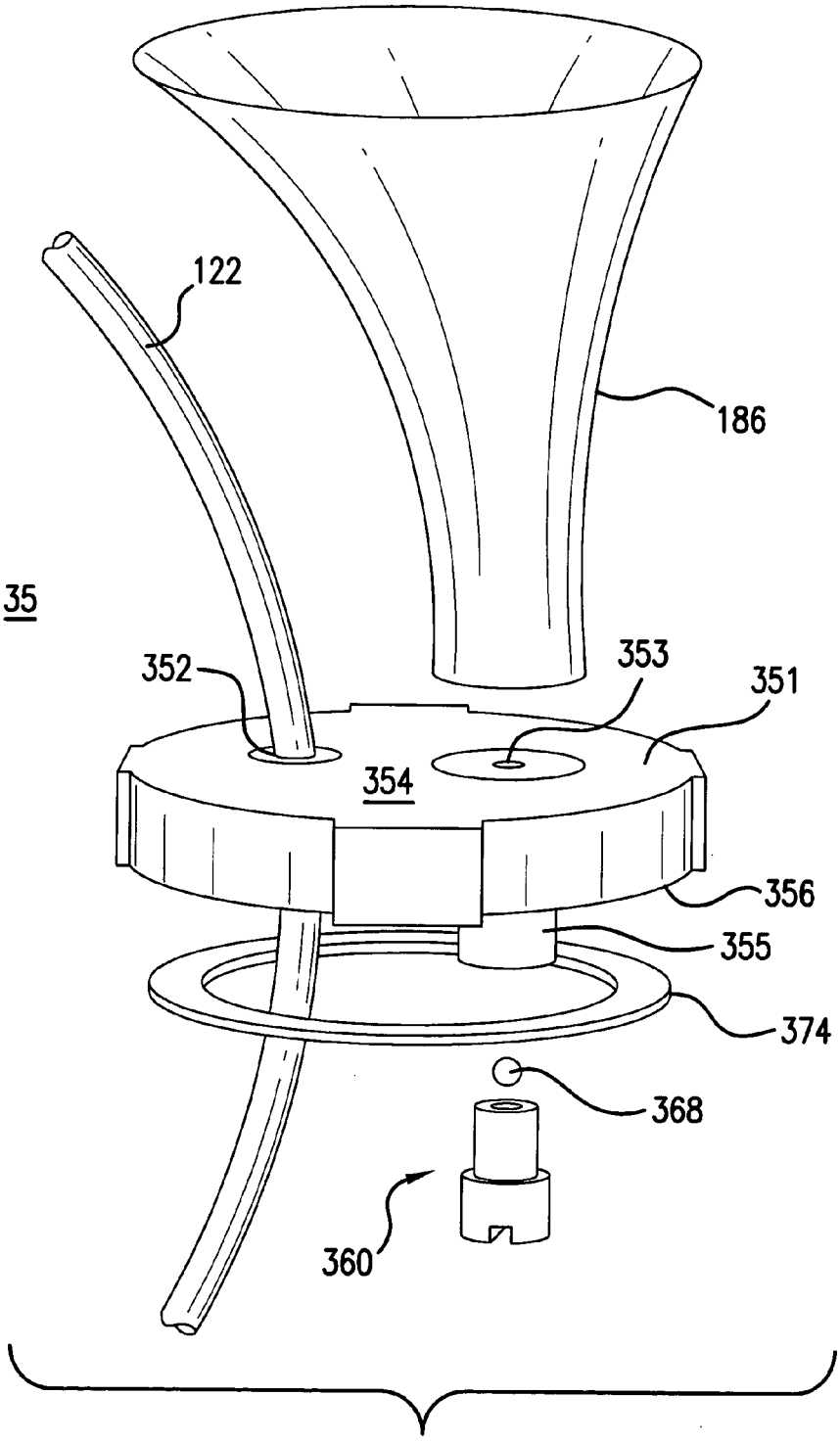
FIG. 19 is an exploded perspective view of the connector of the assembly of FIG. 1.
Figure 20:
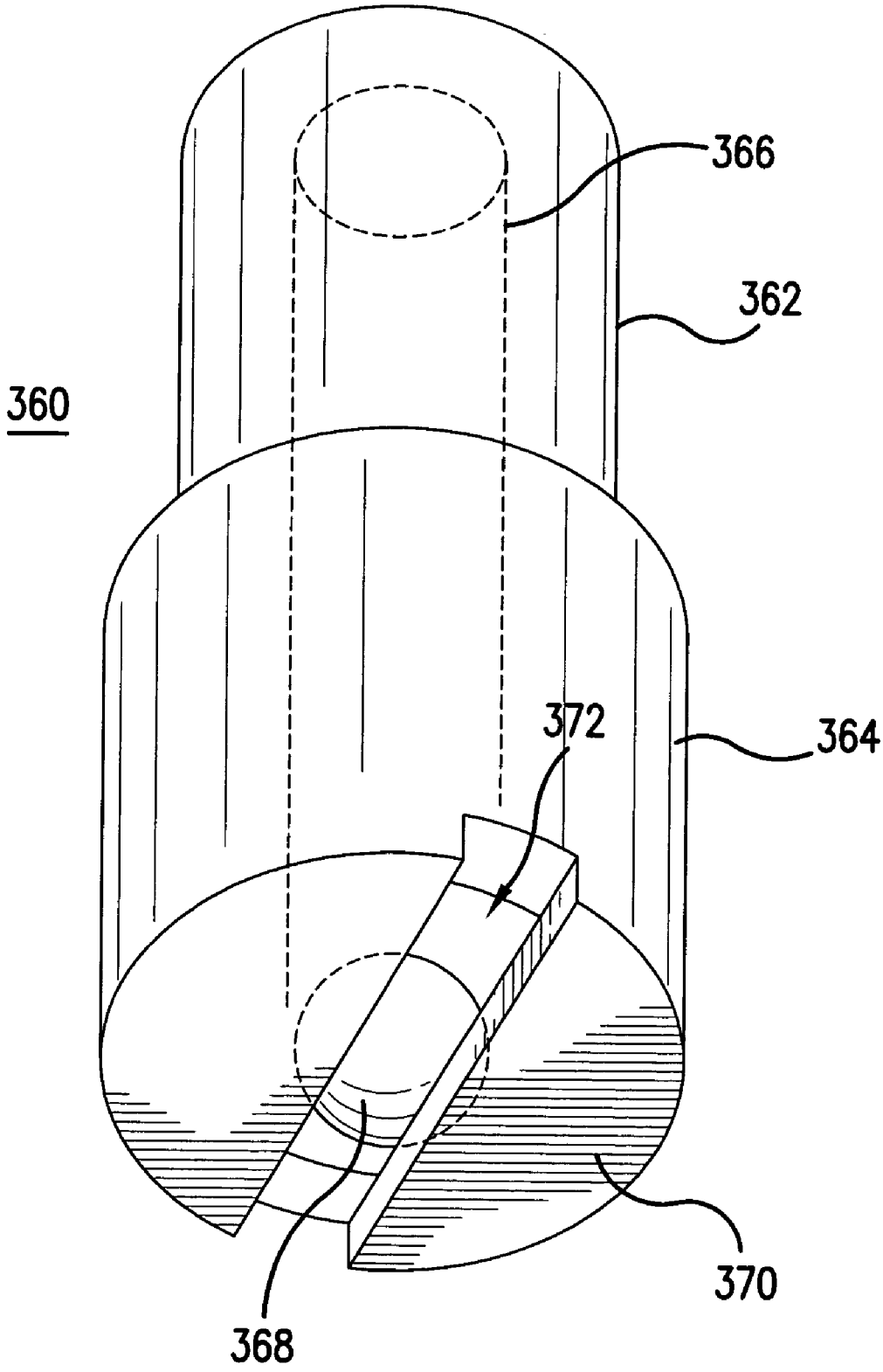
FIG. 20 is a perspective view of the valve element of the connector of FIG. 19.

FIG. 19 illustrates the connector 35. The connector 35 has a cap 351 that is fixedly secured to the housing 22 adjacent the receiving space 30. The cap 351 has a first opening 352 through which the tubing 122 extends, and a second opening 353. The funnel 186 is fixedly attached (e.g., by welding, glue, etc.) to the top surface 354 of the cap 351. A cylindrical extension 355 extends from the bottom surface 356 of the cap 351, and is adapted to receive a valve element 360, which is shown in greater detail in FIG. 20. The valve element 360 has a cylindrical body 362 with a shoulder 364 at its lower end. A bore 366 extends through the cylindrical body 362, and a ball 368 is retained inside the bore 366. The bottom wall 370 of the cylindrical body 362 has an elongated slit 372 which has a width that is smaller than the diameter of the ball 368. Therefore, as shown in FIG. 20, the ball 368 cannot pass through the slit 372, but can only be seated against the slit 372 in a manner that partially, but not completely, blocks the slit 372. A washer 374 can be positioned between the cap 351 and the solution container 32 to prevent leakage of the bubble solution from the solution container 32.

The cylindrical body 362 is inserted into the cylindrical extension 355 and fixedly secured thereto. In addition, the second opening 353 is smaller than the diameter of the ball 368 and the diameter of the bore 366, so that the ball 368 cannot pass through the second opening 353. Thus, when the assembly 20 is oriented in the orientation shown in FIGS. 1–3, the ball 368 will be seated at the bottom of the bore 366 against the slit 372, thereby allowing bubble solution collected by the funnel 186 to flow through the second opening 353, the bore 366, and the portions of slit 372 that are not blocked by the ball 368, back into the solution container 32. On the other hand, if the assembly 20 is inverted, the ball 368 will be abutted against the second opening 353, and will completely block the second opening 353, so that bubble solution from the solution container 32 can flow through the slit 372 and the bore 366, but cannot be spilled through the second opening 353 and the funnel 186.

The assembly 20 operates in the following manner. In the normal (non-operational) position, which is illustrated in FIGS. 2, 4, 6 and 8, the bubble ring 106 is positioned away from the central part of the front opening 38, and in fact, is positioned on the side of the wiping bar 94 that is opposite to the center of the front opening 38. In this normal position, the resilient member 102 normally biases the pivot bar 100 towards one side of the housing 22 (see FIGS. 6 and 8), and the resilient member 76 normally biases the trigger 44 into the opening 42 in the direction of the arrow F. At this time, the user can threadably secure the neck of a solution bottle 32 to the connecting section 34 so that the assembly 20 is ready for use.

The assembly 20 is actuated merely by pressing the trigger 44 in the direction of the arrow R (see FIG. 3) to overcome the natural bias of the resilient member 76, which causes three sequences of events occur at about the same time.

Figure 18:
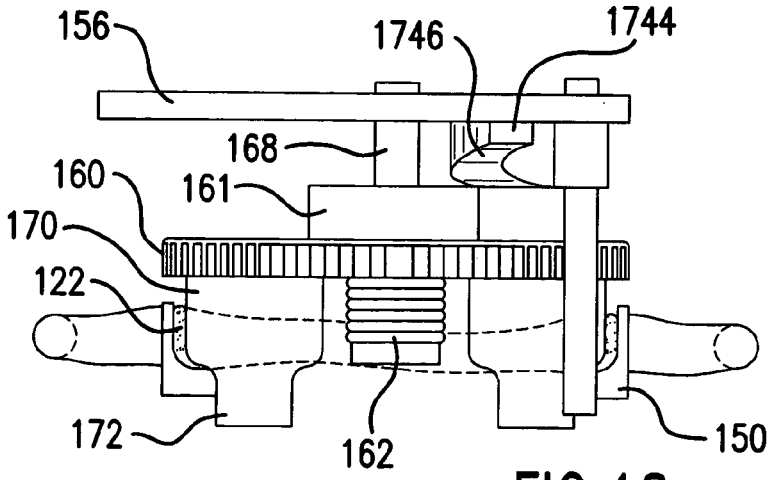
FIG. 18 is an isolated top plan view illustrating the relationship between the pressure rollers and the tube when the assembly of FIG. 1 is in the bubble-generating position.

First, bubble solution is pumped to the bubble ring 106. In this regard, the rearward movement of the trigger 44 causes the electrical contact 60 to engage the motor 50, thereby forming a closed electrical circuit that will deliver power from the power source 48 to the motor 50. The motor 50 will turn on, thereby causing the motor gear 152 to drive and rotate the first and second gears 158 and 160. As the pressure rollers 164, 166 on the second gear 160 rotate, they will apply selected pressure on different parts of the tubing 122. FIGS. 17 and 18 illustrate this in greater detail. FIG. 17 illustrates the relationship between the pressure rollers 164, 166 and the tubing 122 when the assembly 20 is in the normal non-operational condition, and FIG. 18 illustrates the relationship between the pressure rollers 164, 166 and the tubing 122 when the assembly 20 is in the actuated (i.e., bubble-generating) position. As shown in FIG. 17, the tubing 122 is normally fitted between the smaller-diameter upper section 172 of the pressure rollers 164, 166 and the guide wall 150. The resilient element 162 normally biases the second gear 160 towards the gear housing plate 156, and the extension 161 is positioned adjacent the bottom surface 1746 of the terminal tip 1744 of the slider 174. When the trigger 44 is pressed, the trigger 44 pushes the front portion 1741 of the slider 174 (see FIG. 3), overcoming the normal bias of the resilient element 176 and causing the slider 174 to pivot about the axis defined by the shaft 178. As the slider 174 pivots, the curved piece 1743 pushes the extension 161 towards the guide wall 150, causing the pressure rollers 164, 166 to be pushed into the tubing 122 so that the tubing 122 is now positioned between the guide wall 150 and the larger-diameter base section 170 of the pressure rollers 164, 166, thereby compressing the tubing 122 as shown in FIG. 18. Thus, rotation of the pressure rollers 164, 166 will compress different portions of the tubing 122, thereby creating air pressure to draw the bubble solution from the interior of the solution bottle 32 through the tubing 122 into the chamber 112 of the bubble ring 106, where the bubble solution will bleed out through the outlets 118 on to the front surface 120 of the bubble ring 106.

This arrangement and structure of the pressure rollers 164, 166 is effective in prolonging the useful life of the tubing 122 and the pump system. In particular, the pressure rollers 164, 166 only apply pressure against the tubing 122 when the trigger 44 is pressed (i.e., the larger-diameter base section 170 only compresses the tubing 122 when the trigger 44 is pressed), so that the tubing 122 does not experience any pressure when the trigger 44 is not pressed (i.e., the smaller-diameter upper section 172 is positioned adjacent to, but does not compress, the tubing 122 when the trigger 44 is not pressed). This is to be contrasted with conventional pump systems used for pumping bubble solution to a bubble producing device, where pressure is always applied to the tubing regardless of whether the trigger is actuated. Over a long period of time, this constant pressure will deform the tubing, making it difficult for bubble solution to be drawn through the tubing.

Figure 5:
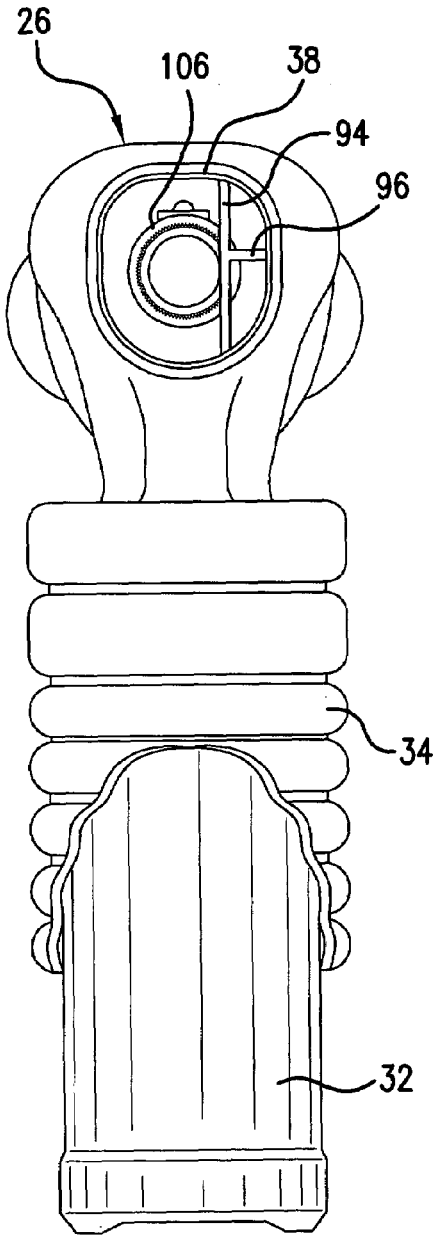
FIG. 5 is a front plan view of the assembly of FIG. 1 shown with the bubble ring in the actuated position.
Figure 4:
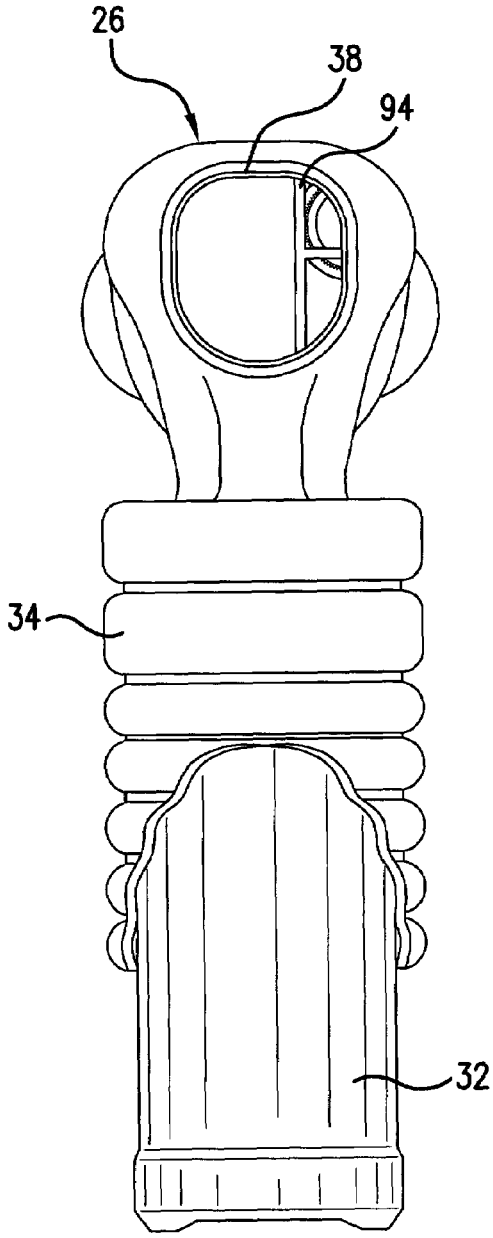
FIG. 4 is a front plan view of the assembly of FIG. 1 shown with the bubble ring in the normal position.
Figure 6:
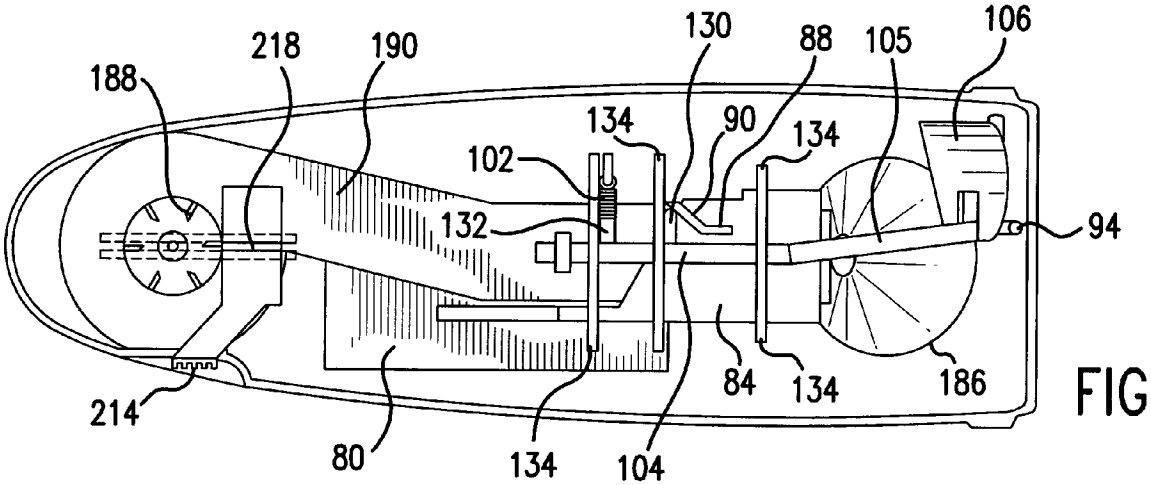
FIG. 6 is a top plan view of the internal components of the assembly of FIG. 1 shown with the bubble ring in the normal position.
Figure 7:
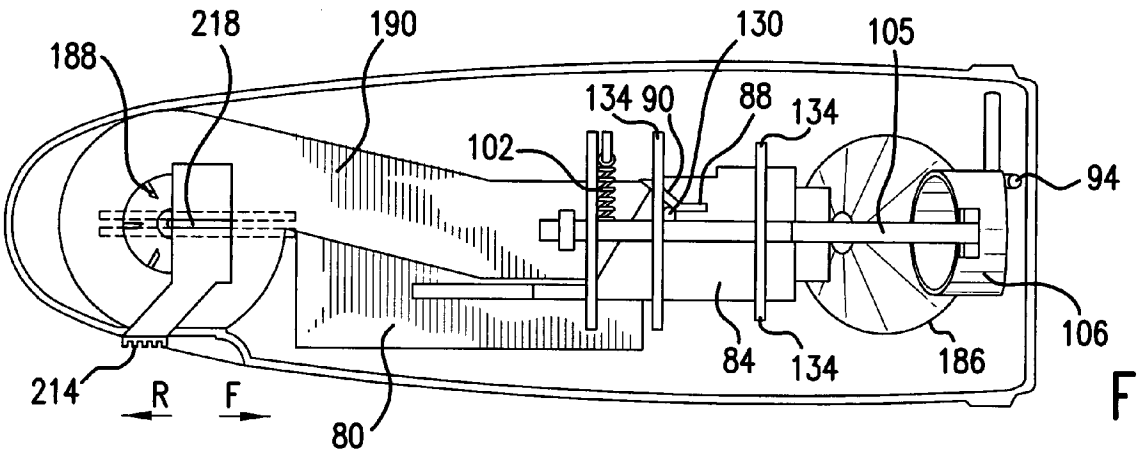
FIG. 7 is a top plan view of the internal components of the assembly of FIG. 1 shown with the bubble ring in the actuated position.
Figure 9:
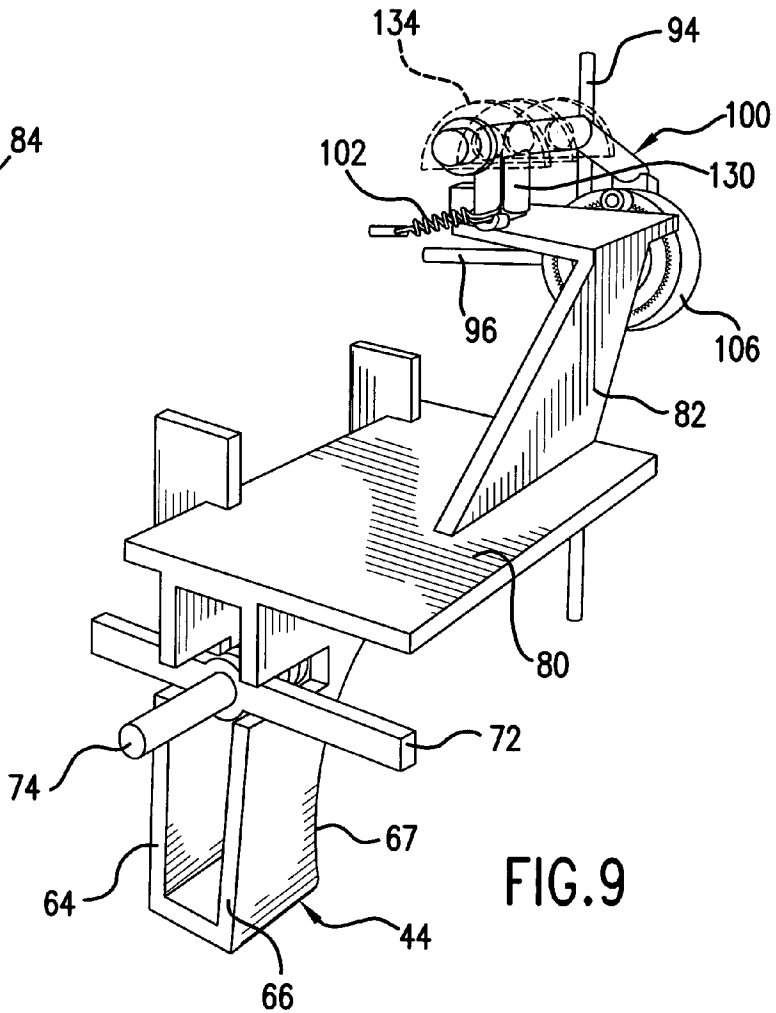
FIG. 9 is an isolated and enlarged perspective view of the link system of the assembly of FIG. 1 shown with the bubble ring in the actuated position.
Figure 8:
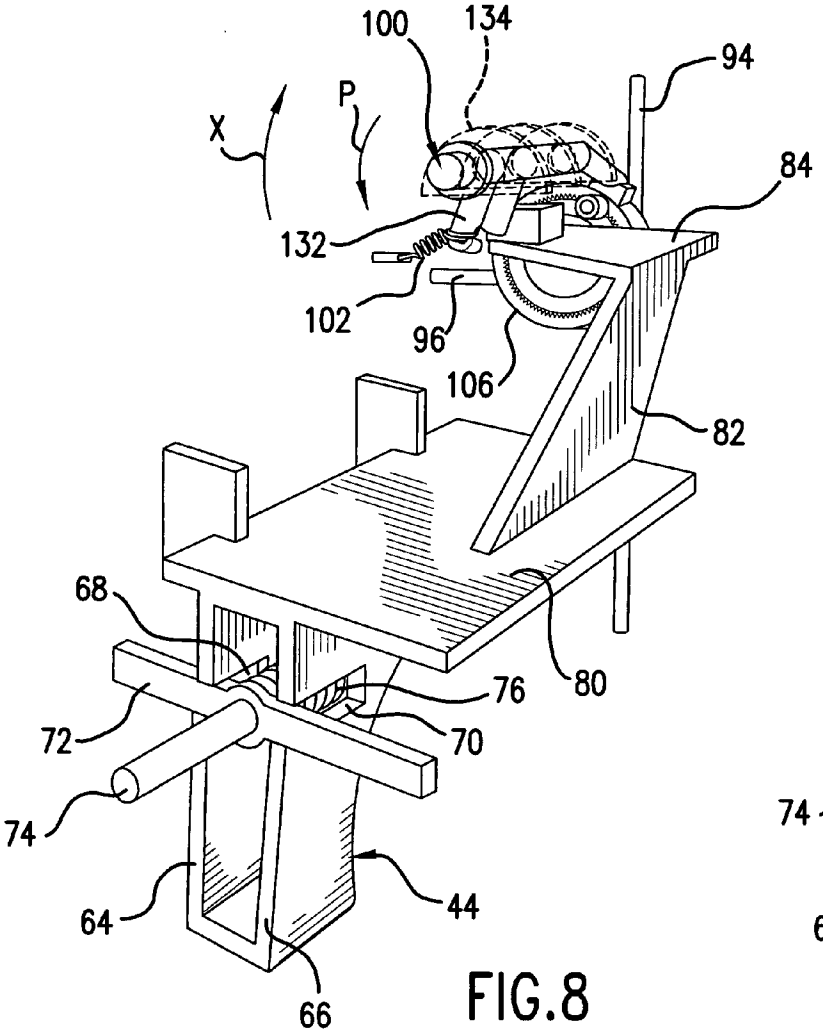
FIG. 8 is an isolated and enlarged perspective view of the link system of the assembly of FIG. 1 shown with the bubble ring in the normal position.
Figure 10:
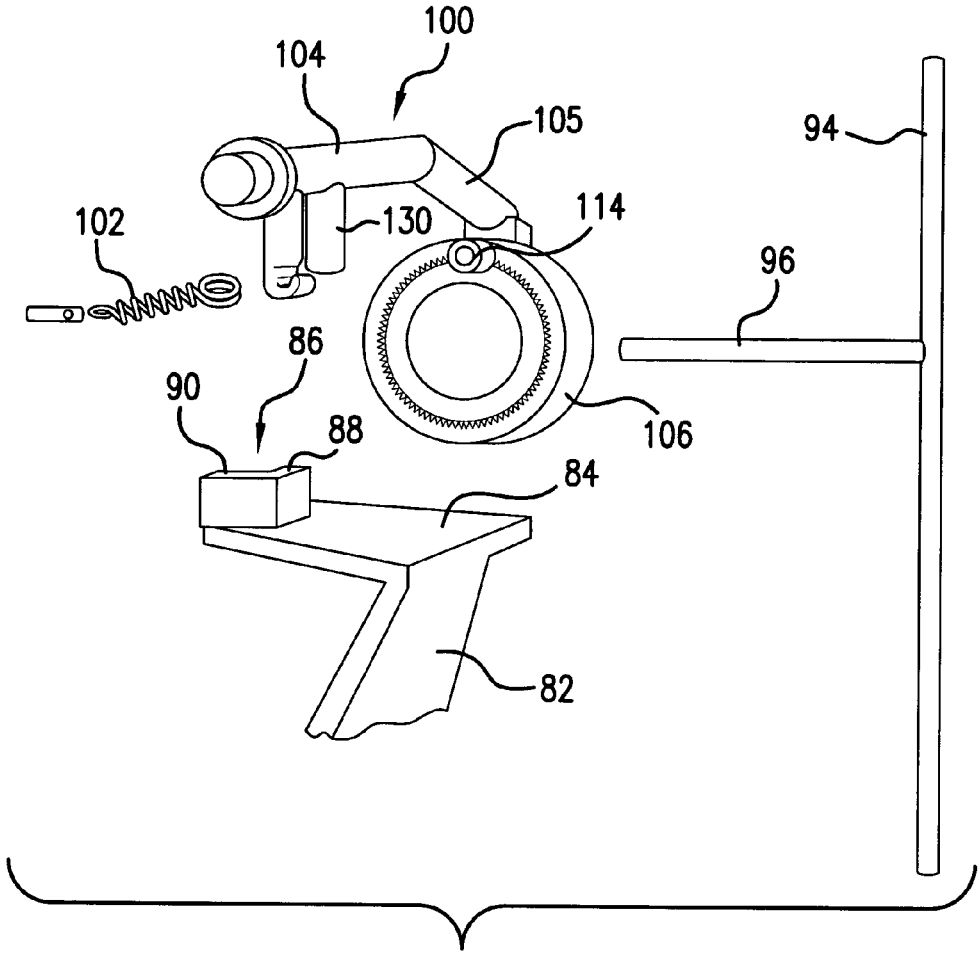
FIG. 10 is an exploded perspective view of the actuation system of the assembly of FIG. 1.
Figure 11:
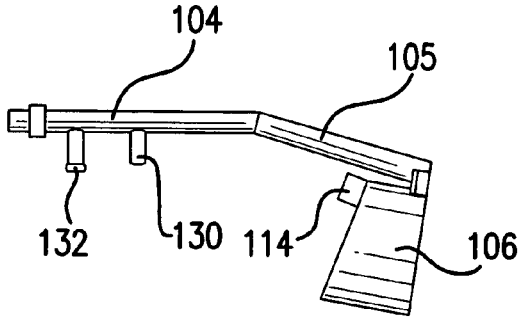
FIG. 11 is a side plan view of the pivot bar of the actuation system of FIG. 10.
Figure 12:
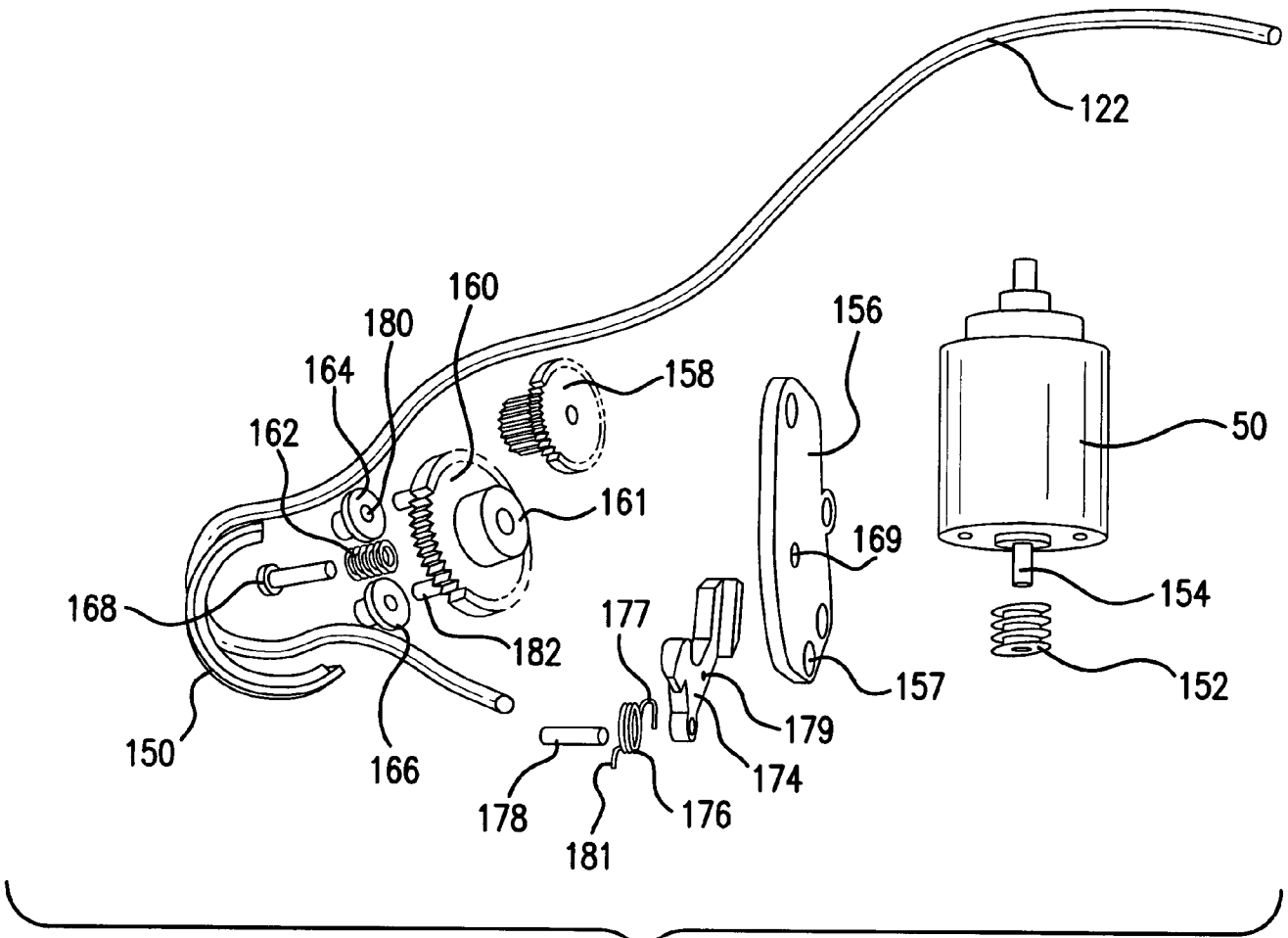
FIG. 12 is an exploded perspective view of the pump system of the assembly of FIG. 1.
Figure 13:
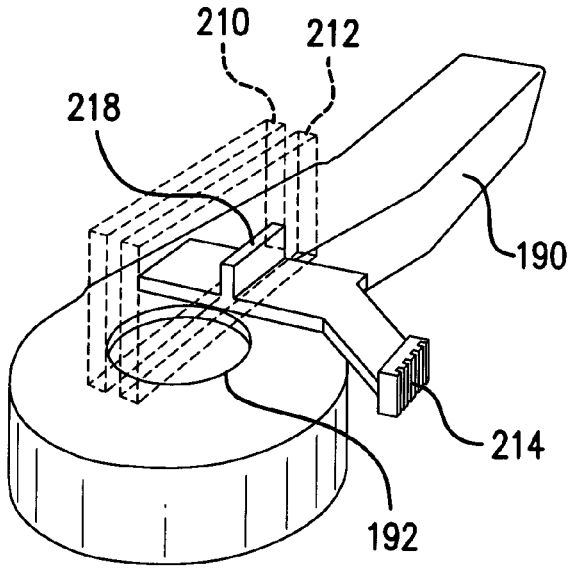
FIG. 13 is an isolated perspective view of the fan system of the assembly of FIG. 1 showing the air control system in a first position.
Figure 14:
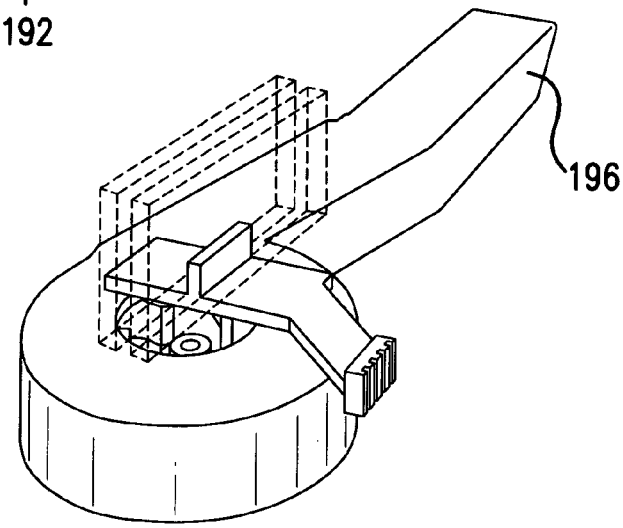
FIG. 14 is an isolated perspective view of the fan system of the assembly of FIG. 1 showing the air control system in a second position.

Second, the bubble ring 106 will be moved from the position shown in FIG. 4 to a position at about the center of the front opening 38, as shown in FIG. 5. As best shown by comparing FIGS. 2, 6 and 8 with FIGS. 3, 7 and 9, respectively, when the trigger 44 is pressed in the direction of arrow R, the platform 80, vertical piece 82, and shelf 84 carried by the trigger 44 will also move in the same direction R. The guide bar 86 that is carried on the shelf 84 will also move in the same direction R. The guide leg 130 is normally biased by the resilient member 102 to be positioned at the rear-most part of the angled segment 90 of the guide bar 86 (see FIGS. 6 and 8). However, as the guide bar 86 moves in the direction R, the guide leg 130 is dragged along the surface of the angled segment 90 from the rear to the front of the angled segment 90. As the guide leg 130 travels along the surface of the angled segment 90 from the rear to the front, the pivot bar 100 is pushed by the angled segment 90 of the guide bar 86 to be pivoted in the curved direction of the arrow P in FIG. 8 (counterclockwise if viewed from the rear of the pivot bar 100), which causes the bubble ring 106 to pivot in the same curved direction P. The curved direction P can approximate the shape of a semi-circle. As the bubble ring 106 pivots in this curved direction P, the bubble ring 106 will travel in a curved path as the front surface 120 of the bubble ring 106 wipes across the stationery wiping bar 94. The limit of the sliding motion of the guide leg 130 along the surface of the angled segment 90 is defined by the point where the angled segment 90 bends into the horizontal segment 88 (see FIGS. 7 and 9). In other words, the guide leg 130 cannot slide beyond this point. At this point, the bubble ring 106 will have completed it curved path across the wiping bar 94 and will be positioned at about the center of the front opening 38 (see FIG. 5), with the opening in the bubble ring 106 being completely clear of the wiping bar 94 and directly facing the open front end 196 of the wind tunnel 190. The wiping motion of the wiping bar 94 along the front surface 120 of the bubble ring 106 will generate a film of bubble solution (from the bubble droplets emitted from the outlets 118) that extends across the opening of the bubble ring 106.

Third, the air generator 188 that is secured to the motor 50 is actuated when the motor 50 is turned on. In this regard, the rearward movement of the trigger 44 causes the electrical contact 60 to engage the motor 50, thereby forming a closed electrical circuit that will deliver power from the power source 48 to the motor 50 to rotate the air generator 188. The air generator 188 blows a stream of air along the wind tunnel 190 towards the bubble ring 106. This stream of air will then travel through the film of bubble solution that has been formed over the bubble ring 106, thereby creating bubbles. The amount of air blown by the air generator 188 through the wind tunnel 190 can be adjusted by manipulating the air control system in the manner described above.

Thus, pressing the trigger 44 will create a film of bubble solution across the bubble ring 106 by (i) pumping bubble solution from the solution bottle 32 to the bubble ring 106, and (ii) and causing the bubble ring 106 to be moved across the wiping bar 94 to the center of the front opening 38 so that bubbles can be created. Pressing the trigger 44 will also actuate the air generator 188 to blow streams of air at the bubble ring 106 to create bubbles.

When the user releases his or her pressing grip on the trigger 44, the resilient member 76 will normally bias the trigger 44 back in the direction F into the opening 42, causing three events to occur.

First, this will cause the electrical contact 60 carried on the trigger 44 to be biased away from the motor 50 so that the electrical circuit is opened, thereby cutting power to the motor 50. As a result, the air generator 188 will stop producing streams of air. This is the first event.

The second event is that the pump system will stop drawing bubble solution from the solution bottle 32 to the bubble ring 106. This occurs because power to the motor 50 has been cut so that the gears 152, 158 and 160 stop rotating, and because the bias of the trigger 44 back in the direction F into the opening 42 will cause the pushing section 45 of the trigger 44 to disengage the front portion 1741 of the slider 174, so that the normal bias of the resilient member 176 will cause the curved piece 1743 of the slider 174 to move from the position shown in FIG. 18 back to the normal (non-operational) position shown in FIG. 17. This movement of the curved piece 1743 allows the normal bias of the resilient member 162 to push the second gear 160 towards the gear housing plate 156 as the extension 161 slides along the bottom surface 1746 of the curved piece 1743. As the second gear 160 moves towards the gear housing plate 156, the tubing 122 will again be positioned between the guide wall 150 and the smaller-diameter upper section 172 of the pressure rollers 164, 166, thereby releasing the pressure applied by the pressure rollers 164, 166 on the tubing 122 as shown in FIG. 17.

In the third event, the movement of the trigger 44 in the direction F will also cause the platform 80, vertical piece 82, shelf 84 and guide bar 86 to move in the direction F. As the guide bar 86 moves in the direction F, the normal bias of the resilient member 102 will cause the guide leg 130 to be dragged along the surface of the angled segment 90 of the guide bar 86 from the front to the rear of the angled segment 90. As the guide leg 130 travels along the surface of the angled segment 90 from the front to the rear thereof, the bias of the resilient member 102 will pivot the pivot bar 100 to be pivoted in the curved direction X (which can also approximate a semi-circular shape) that is opposite to the arrow P in FIG. 8 (clockwise if viewed from the rear of the pivot bar 100), which causes the bubble ring 106 to pivot in the same curved direction X. As the bubble ring 106 pivots in this opposite curved direction X, the bubble ring 106 will travel in a curved path as the front surface 120 of the bubble ring 106 wipes across the stationery wiping bar 94, back to the normal (non-operation) position shown in FIGS. 2, 4, 6 and 8.

In addition, the collection funnel 186 is positioned directly below the bubble ring 106 to collect any stray droplets of bubble solution that drip from the bubble ring 106. These stray droplets can flow back into the solution bottle 32 via the collection funnel 186 and the valve element 360. In addition, the solution bottle 32 can be removed from the housing 22 by threadably disengaging the neck of the solution bottle 32 from the connecting section 34.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A bubble generating assembly comprising:

a housing having a non-movable element secured to the housing;

a trigger mechanism;

a bubble generating ring positioned adjacent the non-movable element;

means for delivering bubble solution to the ring; and a link assembly that couples the trigger mechanism and the ring in a manner in which actuation of the trigger mechanism causes the ring to be moved against the non-movable element.

2. The assembly of claim 1, further including:

a motor operatively coupled to the trigger mechanism;

an air generator coupled to the motor and directing air towards the ring; and a gear system coupled to the motor and applying pressure to the tubing to cause bubble solution to be delivered from the container to the ring.

3. The assembly of claim 2, wherein the housing has a front opening, with the ring positioned adjacent the front opening, and the air generator includes a fan, and a wind tunnel that extends from the fan to adjacent the front opening.

4. The assembly of claim 3, wherein the ring has an interior chamber and an opening communicating with the interior chamber and through which the tubing extends, and a plurality of outlets on the front surface through which bubble solution can flow out.

5. The assembly of claim 3, wherein the trigger mechanism has an electrical contact that removably couples the motor to actuate the motor, and a resilient member that normally biases the electrical contact away from the motor.

6. The assembly of claim 3, wherein the link assembly includes:

a link element connected to the trigger mechanism;

a guide bar positioned on the link element, the guide bar having a guide surface;

a pivot bar pivotably coupled to the housing, the pivot bar have a front end that is attached to the ring, and a guide leg that slidably engages the guide surface;

a resilient member coupled to the pivot bar and normally biasing the pivot bar to pivot in a first direction; and wherein actuation of the trigger mechanism causes the guide leg to slide along the guide surface to overcome the bias of the resilient member, so that the pivot bar pivots in a second direction.

7. The assembly of claim 3, wherein the ring experiences a curved movement as the ring moves against the non-movable element.

8. The assembly of claim 3, further including an air control system that has a cover element which is adjusted to cover selected portions of the air generator to vary the amount of air provided to the air generator.

9. The assembly of claim 3, wherein the ring experiences a semi-circular movement as the ring moves against the non-movable element.

10. The assembly of claim 1, wherein the delivering means includes:

a container coupled to the housing and retaining bubble solution, the container having an interior; and a tubing that couples the interior of the container with the ring.

11. The assembly of claim 10, wherein actuation of the trigger mechanism simultaneously causes (i) the air generator to direct air towards the ring, (ii) the gear system to deliver bubble solution from the container to the ring, and (iii) the ring to move against the non-movable element.

12. The assembly of claim 10, wherein the delivering means further includes the trigger mechanism, at least one rotating pressure roller and a guide wall, the pressure roller having a base section and an upper section that has a smaller diameter than the base section, with the tubing positioned between the upper section of the pressure roller and the guide wall when the trigger mechanism is not actuated, and with the tubing positioned between the base section of the pressure roller and the guide wall when the trigger mechanism is actuated.

13. The assembly of claim 12, wherein actuation of the trigger mechanism pushes the pressure roller towards the guide wall such that the tubing is moved from the upper section to the base section of the pressure roller.

14. The assembly of claim 1, wherein release of the trigger will cause the ring to move away from the non-movable element.

15. The assembly of claim 1, wherein actuation of the trigger mechanism simultaneously causes (i) the delivering means to deliver bubble solution to the ring, and (ii) the ring to move away from the non-movable element.

16. The assembly of claim 1, further including a bubble solution container which is removably coupled to the housing.

17. The assembly of claim 16, further including a collection funnel positioned below the ring, with the container being removably coupled to the collection funnel so that droplets received on the collection funnel can flow into the container.

18. The assembly of claim 1, wherein the ring is positioned inside the housing.

19. A bubble generating assembly comprising:

a housing having a non-movable wiping bar secured to a portion of the housing;

a trigger mechanism;

a bubble generating ring positioned adjacent the non-movable wiping bar; and a link assembly that couples the trigger mechanism and the ring in a manner in which actuation of the trigger mechanism causes the ring to be moved in a curved manner from a first position to a second position across the wiping bar.

* * * * *